United States Patent [19]

Shirosaka

[11] Patent Number: 5,006,858

[45] Date of Patent: Apr. 9, 1991

[54] MICROSTRIP LINE ANTENNA WITH CRANK-SHAPED ELEMENTS AND RESONANT WAVEGUIDE ELEMENTS

[75] Inventor: Toshiaki Shirosaka, Toyono, Japan

[73] Assignee: DX Antenna Company, Limited, Kobe, Japan

[21] Appl. No.: 462,137

[22] Filed: Jan. 8, 1990

[30] Foreign Application Priority Data

Mar. 30, 1989 [JP] Japan ..... 1-80694

[51] Int. Cl.[5] ..... H01Q 1/38

[52] U.S. Cl. ..... 343/700; 343/731; 343/829

[58] Field of Search ..... 343/700, 731, 829, 846, 343/833

[56] References Cited

U.S. PATENT DOCUMENTS 4,652,889 3/1987 Bizouard et al. ..... 343/700

4,893,129 1/1990 Kodera et al. ..... 343/700

FOREIGN PATENT DOCUMENTS 2064877 6/1981 United Kingdom ..... 343/700

*Primary Examiner*—Michael C. Wimer

*Attorney, Agent, or Firm*—Morris Fidelman; Franklin D. Wolffe

[57] ABSTRACT

A microstrip line antenna generally used for receiving an electric wave from an artificial satellite, which comprises a plane dielectric substrate and a plurality of crank-shaped microstrip lines arranged on the substrate. The improvement comprises a number of half wavelength waveguide elements arranged on a plane lying parallel to the substrate in front of the microstrip lines at a predetermined distance therefrom for improving the signal-to-noise ratio of the antenna and reducing the number of antenna elements.

4 Claims, 6 Drawing Sheets

MICROSTRIP LINE ANTENNA WITH CRANK-SHAPED ELEMENTS AND RESONANT WAVEGUIDE ELEMENTS

BACKGROUND OF INVENTION

This invention relates to a plane antenna utilizing microstrip lines and, especially, to a crank-shaped microstrip line antenna having the number of elements reduced for obtaining directivity in a slanting direction and reducing its size.

As shown in FIGS. 9 and 10 of the Japanese patent opening gazette No. 57-99803 or FIGS. 10 and 11 of the corresponding U.S. Pat. No. 4,475,107, a typical example of the crank-shaped microstrip line antenna is composed of a pair of conductors each having relatively long hill portions and relatively short valley portions which are connected alternately. The two conductor lines which form the pair are arranged in parallel in such a relationship in that each valley portion of one conductor line faces to the middle of each hill portion of the other. Each part of the pair of conductor lines having a length corresponding to the sum of one hill portion and one valley portion constitutes an antenna element for circularly or linearly polarized radiation of electromagnetic wave corresponding to twice the wavelength thereof. Accordingly, the antenna as shown in the abovecited drawings consists of three elements.

As the conductor lines are formed on a dielectric substrate, the wavelength of the electromagnetic wave on the conductor lines differs from the wavelength in space in correspondence with the dielectric constant $\epsilon$ of the substrate even at the same frequency. For example, the wavelength of an electromagnetic wave on a conductor line formed on a polyethylene substrate ($\epsilon=2.5$) is reduced to about 63% of the wavelength in space and the wavelength of the electromagnetic wave on a conductor line formed on a foamed polyethylene substrate ($\epsilon=1.7$) is reduced to about 80% of the wavelength in space.

In the above-mentioned crank-shaped microstrip line antenna, the main beam of radiation is directed normally to the antenna plane when the length of each conductor line in each antenna element corresponds to twice the wavelenqth of the electromaqnetic wave. Such directivity is referred to as "broad side type". However, the main beam of radiation is directed to a slanting direction when the length of each portion of the crank-shaped conductor is expanded in the longitudinal direction of the microstrip line. Such directivity is referred to as "side looking type".

When one intends to receive an electric wave from a stationary artificial satellite in a region of middle or high latitude with a parabolic antenna or a plane of broad side type, it is necessary to raise the antenna very much from the horizontal plane so as to put the antenna aperture plane or the antenna plane normally to the incoming direction of the electric wave. This results in the antenna being subjected to an increased wind pressure when the antenna is disposed on the roof of a running vehicle. However, this wind pressure should be reduced with a plane antenna of side looking type having suitably slanted directivity, since it can effect reception where in a nearly horizontal attitude.

A conventional microstrip line antenna includes about ten crank-shaped antenna elements connected in series. Although the gain of the antenna rises with increase of the number of these elements, the frequency bandwidth becomes narrow. On the contrary, the frequency bandwidth increases and the gain decreases with reduction of the number of serial crank-shaped antenna elements. Accordingly, it has been a general practice that a patch antenna element is added to the end of each line of elements for improving the gain in case of the antenna of broad side type having fewer crank-shaped antenna elements.

If one intends to provide the prior art crank shaped antenna as shown in the above mentioned patent with a side looking property, it will be necessary to largely increase the length of each antenna element. For example, when the direction of radiation of the main beam is slanted by 28 degrees, the length of each antenna element viewed from this direction is reduced only by a factor of 0.88 or cos 28°. In practice, however, the direction of radiation can not be slanted by 28 degrees unless the length of each antenna element is increased by a factor of 1.5. This results in significant reduction in the number of antenna elements which can be arranged in series and consequent reduction in the antenna gain.

Although the main beam of radiation of the electric wave to be used is directed to a direction slanted by 28 degrees when the length of each antenna element is expanded by a factor of 1.5, for example, in order to obtain the side looking property, it is necessary to pay attention to the fact that the main beam of the electric wave having a wavelength increased by a factor of about 1.5 is radiated to a direction nearly vertical to the antenna plane. For the same reason, electric waves having wavelengths which are 1.0 to 1.5 times the wavelength of the electric wave to be used are radiated to respective directions between zero and 28 degrees. It is also understood that an electric wave having a wavelength shorter than that of the electric wave to be used is radiated to a direction slanted by much more than 28 degrees. It will be understood also in case of the crank-shaped microstrip line antenna of broad side type that undesirable electric waves having shorter wavelengths than the electric wave to be used and radiated normally to the antenna plane are radiated in slanting directions.

Accordingly, a first object of this invention is to suppress the electric wave radiation of undesirable wavelength directed to undesirable direction to improve the signal-to-noise ratio of the antenna.

As described above, in the microstrip line antenna of broad side type, the gain reduction due to the reduced number of serial antenna elements can be compensated by the addition of patch antenna element to the end of each line. However, it is difficult for the patch antenna element to reduce the energy radiated to the front direction by the phase difference to obtain the side looking property since it has a large gain only in the front direction. Therefore, it is ineffective as a countermeasure to the reduction of antenna elements effected for providing the crank-shaped antenna with the side looking property.

Accordingly, a second object of this invention is to provide a crank-shaped microstrip line antenna having relatively few elements, especially, a crank-shaped antenna having improved antenna gain and aperture efficiency and consequent inprovement in radiation efficiency of each antenna element and in directivity gain regardless of the number of antenna elements reduced for obtaining the side looking property.

SUMMARY OF INVENTION

According to this invention, there is provided a microstrip line antenna comprising a parallel arrangement of a plurality of crank-shaped conductor lines formed on a surface of a dielectric substrate, and a close arrangement of a number of half wavelength waveguide elements which are respectively parallel to the longitudinal and lateral components of the crank. The arrangement of the half wavelength conductor elements is formed in a plane lying in parallel to and in front of the substrate at a distance substantially equal to a half wavelength of the electric wave to be used or an integral multiple thereof, and each half wavelenqth waveguide element has a length which can resonate with the half wavelength of the electric wave to be used.

These and other objects and features to this invention will be described in detail below with reference to the accompanying drawings.

BRIEF DESCRIPTION OF DRAWINGS

In the drawings.

Throughout the drawings, same reference numerals are given to corresponding structural components.

DESCRIPTION OF PREFERRED EMBODIMENT

Figure 1:
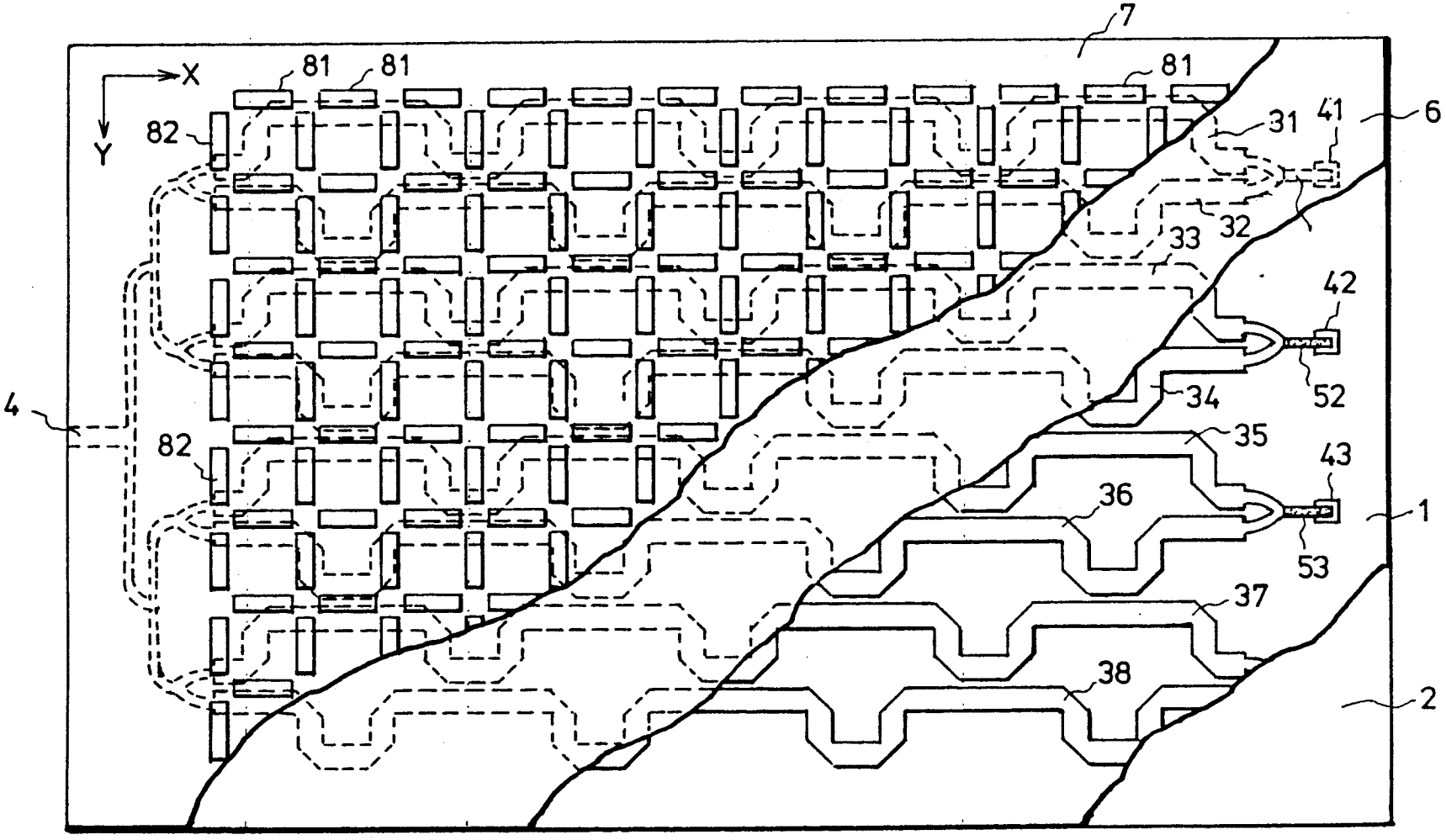
FIG. 1 is a partly broken-away plan view representing an embodiment of this invention.
Figure 3:
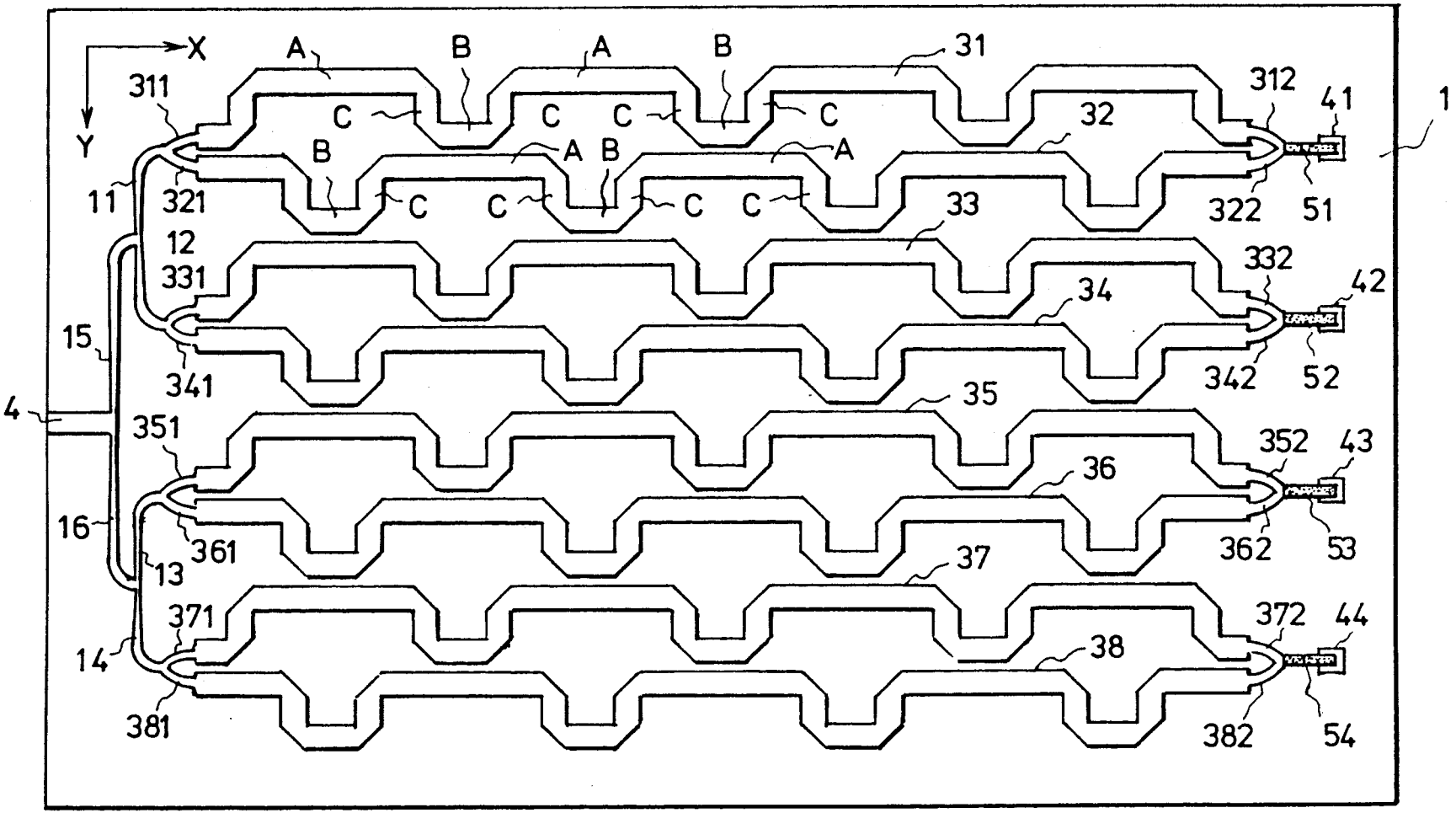
FIG. 3 is a plan view representing the microstrip lines of the embodiment of FIG. 1.
Figure 2:
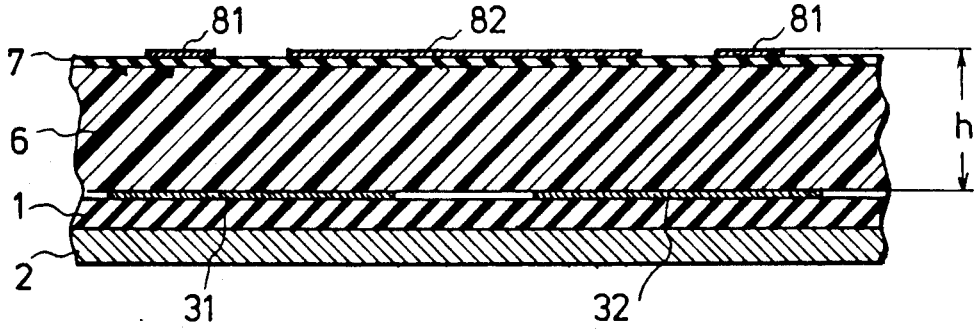
FIG. 2 is a partial sectional side view representing the embodiment of FIG. 1.

Referring to FIGS. 1 and 2, a substrate 1 made of foamed polyethylene has an aluminium ground plate 2 laminated on its back surface and a pattern of crank-shaped conductor lines 31, 32, 33, 34, 35, 36, 37 and 38 formed of copper foil on its front surface as shown in FIG. 3. As an example, the substrate 1, ground plate 2 and copper foil are 0.8 mm, 1 mm and 0.03 mm thick, respectively.

Figure 4:
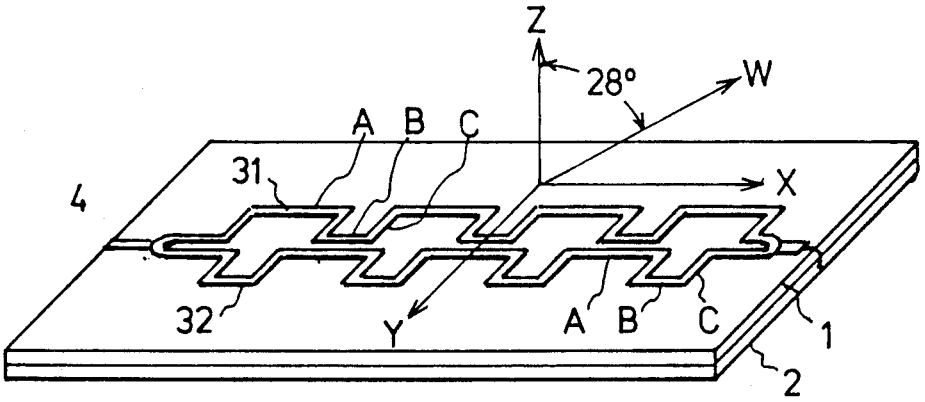
FIG. 4 is a perspective view representing a pair of crank-shaped conductor lines formed on a substrate.

Assuming now the longitudinal direction of the conductor lines 31 to 38 as direction X, the direction normal to direction X along the substrate as direction Y and the direction normal to the substrate as direction Z, as shown in FIG. 4, each conductor line includes alternately relatively long portions A in direction X and relatively short portions B in the same direction X and these portions A and B are connected through portions C in direction Y. As an example, the sizes of respective portions are as follows when the frequency of the electric wave is 12GHz and the electric wave is radiated in direction W which slants by 28 degrees from direction Z to direction X as shown.

Width of lines 31 to 38: 4.0 mm

Length of conductor line of portion A: 29.2 mm

Length of conductor line of portion B: 21.0 mm

Length of conductor line of portion C: 10.0 mm

As shown in FIG. 3, input conductors 311 and 321 of the conductor lines 31 and 32 are connected to a conductor 11, input conductors 331 and 341 of the conductor lines 33 and 34 are connected to a conductor 12, input conductors 351 and 361 of the conductor lines 35 and 36 are connected to a conductors 13 and input conductors 371 and 381 of the conductor lines 37 and 38 are connected to a conductor 14. The conductor 11 and 12 are connected to a conductor 16 and the conductors 13 and 14 are connected to a conductor 16. The conductors 15 and 16 are connected to an input terminal 4. The conductors 321, 331, 341, 351, 361, 371, 381, 11, 12, 13, 14, 15 and 16 and the input terminal 4 are formed also of copper foil on the substrate as same as the conductor lines 31 to 38.

A terminal resistor 51 is soldered between output conductors 312 and 322 of the conductor lines 31 and 32 and a grounding conductor 41, a terminal resistor 52 is soldered between output conductors 332 and 342 of the conductor lines 33 and 34 and a grounding conductor 42, a terminal resistor 53 is soldered between output conductors 352 and 362 of the conductor lines 35 and 36 and a grounding conductor 43 and a terminal resistor 54 is soldered between output conductors 372 and 382 of conductor lines 37 and 38 and a grounding conductor 44. The conductors 312, 322, 332, 342, 352, 362, 372, 382, 41, 42, 43 and 44 are also formed of copper foil on the substrate 1 as same as the conductor lines 31 to 38. The value of each terminal resistor 51 to 54 is equal to the impedance of the conductor line and, for example, if the line impedance is 50 ohms, it is also 50 ohms. The grounding conductors 41, 42, 43 and 44 are grounded for high frequency by being electrostatically connected to the ground plate 2.

Figure 5:
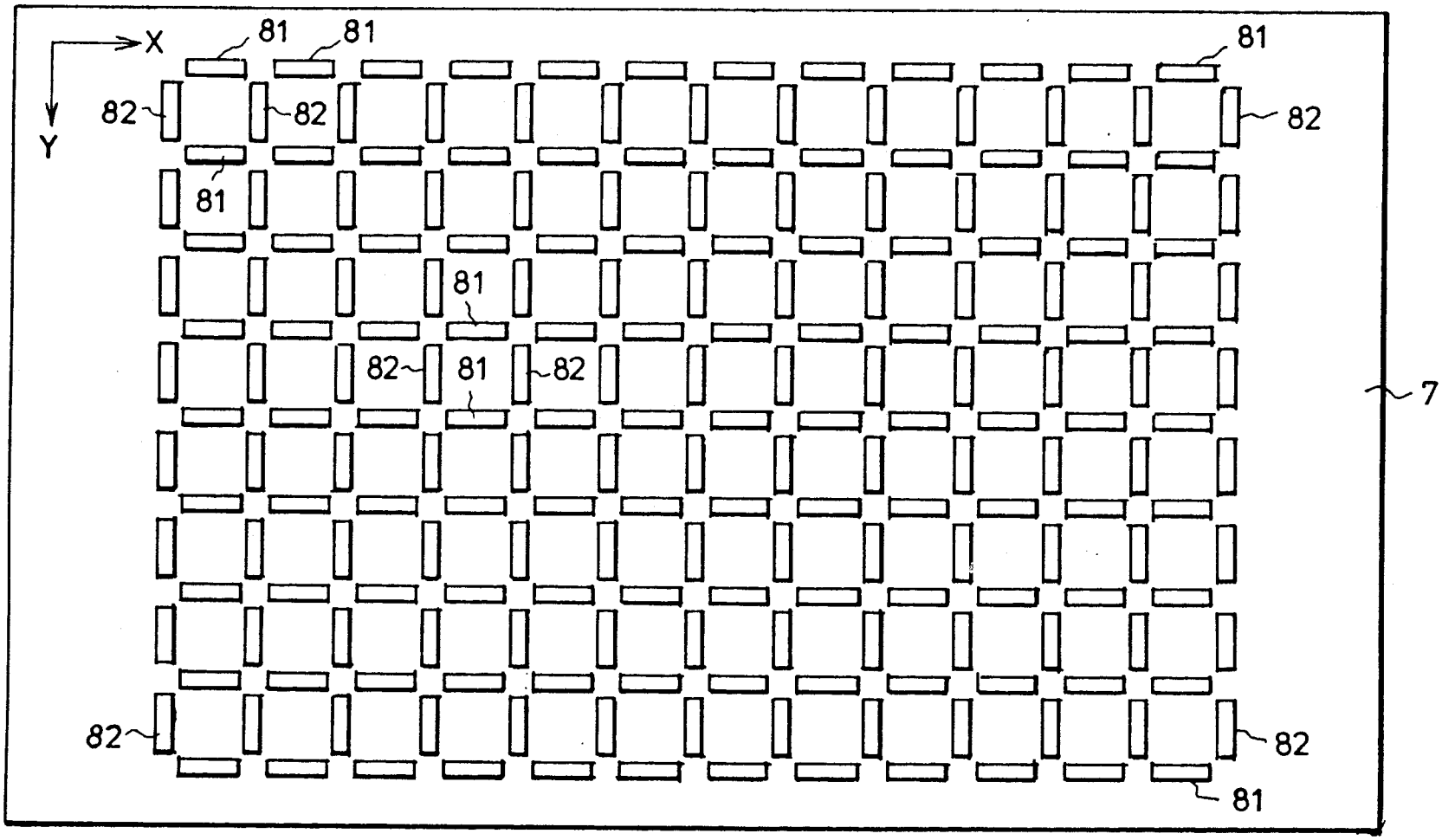
FIG. 5 is a plan view representing an arrangement of half wavelength waveguide elements in the embodiment of FIG. 1.

A low density foamed styrene plate 6 is laminated on the surface of substrate 1 on which the conductor lines 31 to 38 are formed and a thin polyester film 7 is further laminated on the surface of foamed styrene plate. On the surface of polyester film 7, as shown in FIG. 5, a number of half wavelength waveguide elements 81 in X direction and a number of half wavelength waveguide elements 82 in Y direction are formed by aluminium evaporation. As an example, a foamed styrene plate 6 is preferably 14.5 mm to 15 mm thick and the half wavelength waveguide element is preferably 2 mm wide and 8.75 mm long in the case of 12GHz electric wave.

Figure 6:
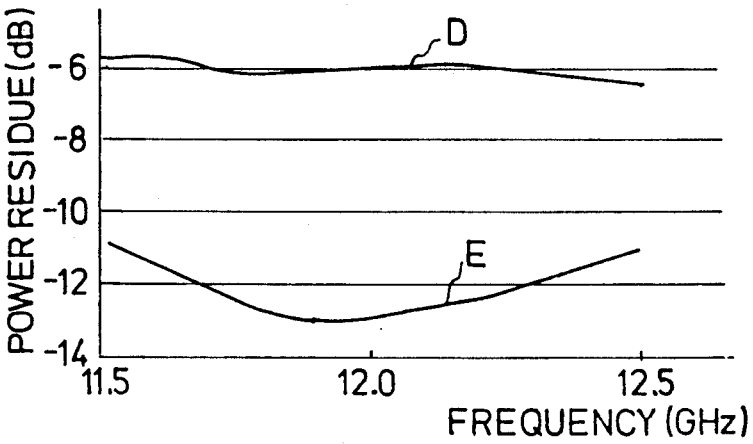
FIG. 6 is a diagram representing a frequency characteristics of the rate of terminal power residue of the prior art and inventive antennas.

FIG. 6 shows a frequency characteristic of the ratio of power applied to the input terminal 4 of the above mentioned antenna having four elements in each line and residual power absorbed by the terminal resistors 51 to 54, in which Curve D corresponds to the case where the half wavelength waveguide elements 81 and 82 are not used and Curve E corresponds to the case where these elements are used. It is understood therefrom that 94% to 95% of the input is radiated by using the half wavelength waveguide elements though only 75% thereof is radiated without these elements.

Figure 7:
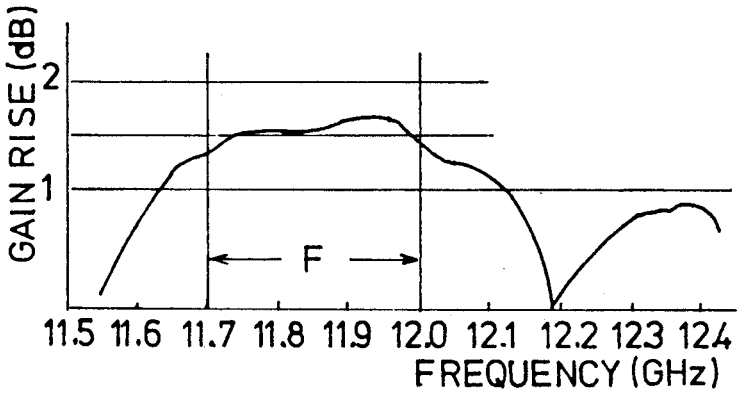
FIG. 7 is a diagram representing frequency characteristic of gain rise of the inventive antenna.

FIG. 7 shows a frequency characteristic of gain rise of an inventive antenna for 12GHz having sixteen lines each composed of nine elements where the beam slanting angle is 28 degrees as shown in FIG. 4. It is understood therefrom that the antenna gain is substantially increased by using the half wavelength waveguide elements as compared with the case corresponding to 0dB where these elements are not used. In the drawing, the arrowed range F is the frequency range of the electric wave to be used.

Figure 8:
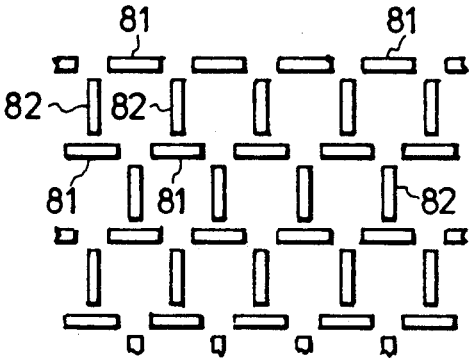
FIGS. 8 and 9 are partial plan views representing two alternatives of the arrangement of half wavelength waveguide elements according to this invention.
Figure 9:
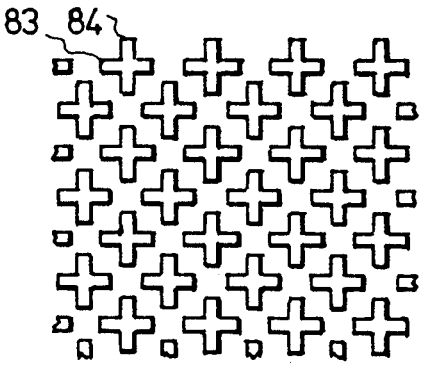

The arrangement of the half wavelength waveguide elements of FIG. 5 can be modified as shown in FIG. 8. In the drawing, the half wavelength waveguide elements 81 and 82 of every other line are shifted by a length corresponding to a half wavelength. This length may be not only a half wavelength but also any length such as a quarter or one tenth wavelength. FIG. 9 shows another modification in which both waveguide elements are mutually superposed to form crosses having X portion 83 and Y portion 84. Each portion has a length corresponding to 0.35 times the wavelength.

It is practical to form the conductor lines 31 to 38 on the front surface of the substrate 1 by etching a copper foil laminated on the substrate. The sizes of the respective portions of the crank of each conductor line are determined as described in FIG. 11 of the aforementioned U.S. patent when the antenna is of broad side type, while they are expanded in the direction X in accordance with the slanting angle of the main beam of radiation when the antenna is of side looking type.

Figure 10:
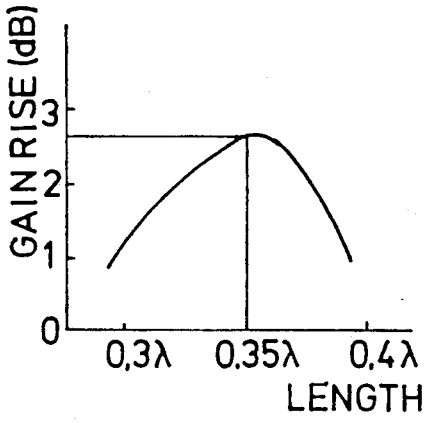
FIG. 10 is a diagram representing a relation between the length of half wavelength waveguide element and the antenna gain.

The half wavelength waveguide elements are preferably formed on a dielectric film having high electric wave permeability by evaporation of metal or printing with electroconductive ink. The actual length of each half wavelength waveguide element is rather shorter than a half wavelength of the actual electric wave, since it corresponds t the length suitable for the conductor coming in a resonance condition with a half wavelength of the electric wave to raise the antenna gain. For example, it has been found that the antenna gain becomes maximum when the length of waveguide element is about 0.3λ as shown in FIG. 10 where λ is the wavelength, the distance h from the conductor lines to the half wavelength waveguide elements is 0.55λ and the width of each waveguide element is 0.08λ.

Figure 11:
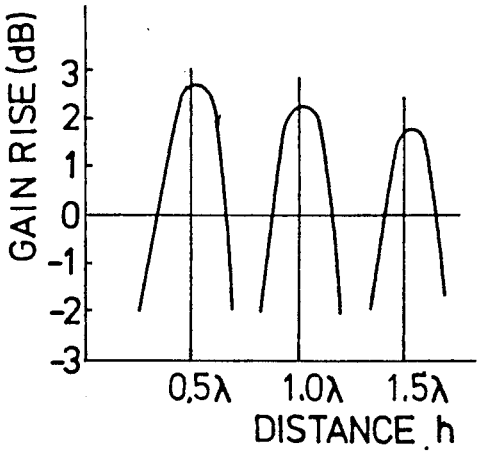
FIG. 11 is a diagram representing a relation between the distance of the half wavelength waveguide elements from the antenna elements and the antenna gain.

While the foamed polystyrene plate 6 is used in the above embodiment for keeping the distance h, a honeycomb plate made of low loss material such as paper or synthetic resin may be used instead. As shown in FIG. 11, the antenna gain becomes highest when the thickness h of the plate is about a half wavelength of the electric wave and also becomes maximum when it is an integral multiple thereof.

Figure 12:
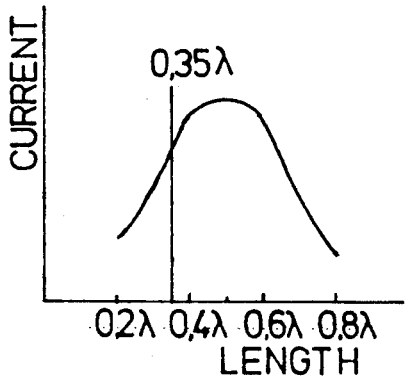
FIG. 12 is a diagram representing a relation between the length of half wavelength waveguide element and the magnitude of resonance current.
Figure 13:
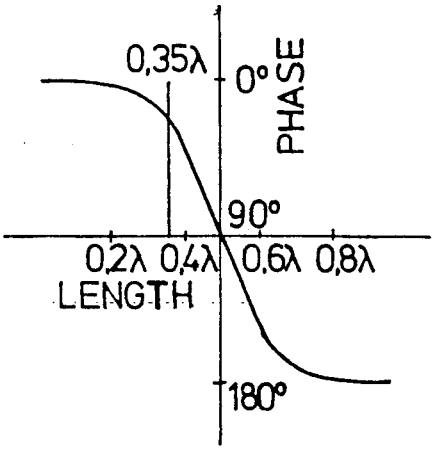
FIG. 13 is a diagram representing a relation between the length of half wavelength waveguide element and the phase of resonance current.

The electric wave radiated from the crank-shaped conductor lines reaches the half wavelength waveguide elements to induce a resonance current flowing therethrough. As the wave is horizontally and vertically polarized, the resonance current flows through the respective waveguide elements in a similar fashion to the respective portions of the crank. Then, the relationship between the length of each waveguide element and the magnitude and phase of the resonance current flowing therethrough is as shown in FIGS. 12 and 13, respectively. More particularly, while the resonance current becomes maximum when the length of waveguide element corresponds to a half wavelength (0.5λ) of the electric wave, this does not contribute to increase of the antenna gain as shown in FIG. 10 since the current phase differs by 90 degrees from the wave phase. When the length of waveguide element is below 0.3 times the wavelength (0.3λ), it also does not contribute to increase of the antenna gain since the current flowing therethrough is significantly low, though the current phase almost coincides with the wave phase. When the length of waveguide element is about 0.35 times the wavelength (0.35λ), it significantly raises the antenna gain as shown in FIG. 10, since the resonance current is substantially large and its phase is rather close to the wave phase.

Figure 14:
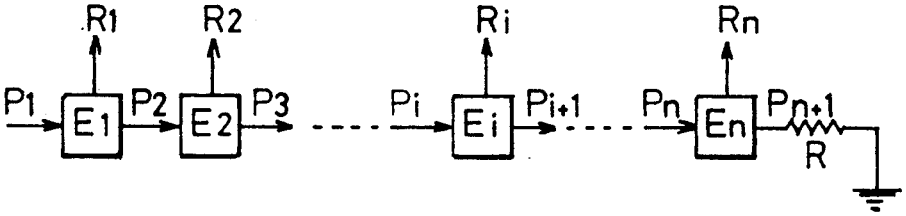
FIG. 14 is a block diagram representing the movement of power through the respective antenna elements.

A row of n-number of antenna elements composed of a pair of conductor lines can be expressed as a series circuit of elements $E_1, E_2, \ldots E_i, \ldots E_n$ as shown in FIG. 14, where "i" is any integer between 1 and n. As all antenna elements are same in structure, any description about the i th element $E_i$ is applicable to all antenna elements. When power $P_i$ is applied to the antenna element $E_i$, power $R_i$ is radiated therefrom and the following residual power is transferred to the next element $E_{i+1}$.

$$P_i - R_i = P_{i+1}$$

If the radiation effciency of each antenna element is K ($=R_i/P_i$). the following power is left in the last element $E_n$ and absorbed by the terminal resistor R.

$$P_{n+1} = P_1(1-K)^n$$

Figure 15:
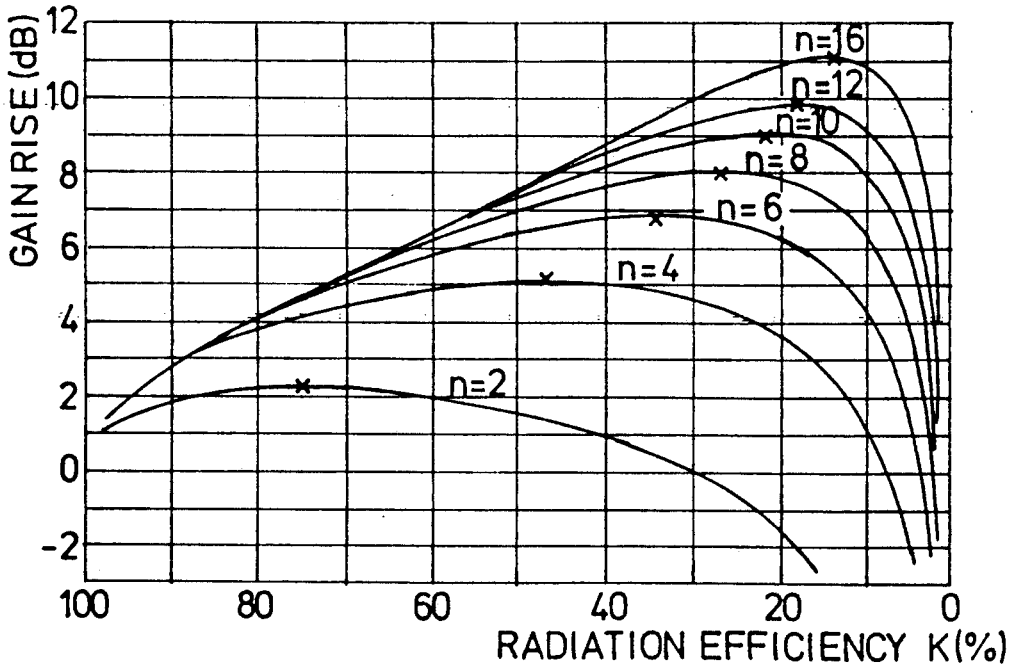
FIG. 15 is a diagram representing a relation between the radiation efficiency of each antenna element and the gain of multi-element antenna.

When the radiation efficiency K of each antenna element is put on the abscissa and calculated increment of the antenna gain having n number of elements is put on the ordinate, a diagram is obtained as shown in FIG. 15. Although the radiation efficiency of each antenna element can be raised by increasing the width of the copper foil constituting the conductor line, it is generally as small as 10% to 30% since excessive increase of the foil width affects the shape of crank.

In FIG. 15, the mark "x" indicates such conditions in that the maximum antenna gain is obtainable. It is understood therefrom that the maximum gain condition can be easily attained if the number of elements n is above eight (8) even if the radiation efficiency K of each antenna element is within the general range from 10% to 30%, but it cannot be attained unless the radiation efficiency K is above 30%, if the number of elements n is below six (6). Such high radiation efficiency cannot be realized by conventional means. According to this invention, however, the value of K can be raised to about 50% by arranging half wavelength waveguide elements in front of the antenna elements. Therefore, the antenna gain can be raised to the greatest extent even when the number of elements n is four (4). Accordingly, it is possible to effectively raise the gain of a crank shaped microstrip line antenna whose elements have been reduced for attaining small size, wide band and side looking property.

The half wavelength waveguide elements can suppress radiation of electric wave of undesirable wavelength directed to undesirable direction, since they exhibit their antenna gain raising function only to an electric wave of predetermined wavelength.

Although the above description has been made about a transmitting antenna, it is obvious that it can be operated reversibly as a receiving antenna which is also within the scope of this invention.

I claim:

1. A plane antenna comprising:

a microstrip line antenna including a plane dielectric substrate and a plurality of parallel conductor lines arranged on said substrate along a first direction, each of said conductor lines comprising a plurality of antenna elements sequentially connected together to form a crank-shaped conductor pattern, each of said elements comprising a relatively long first segment and a relatively long second segment with said first and second segments oriented in said first direction and a relatively short third segment oriented in a second direction normal to said first direction and connecting said first and second segments together in said crank-shaped conductor pattern, a plurality of half wavelength waveguide elements lying on a plane parallel to said substrate, extending respectively in said first and second directions and each waveguide element comprising a conductor resonant with a half wavelength of an electric wave to be used, and means for supporting said half wavelength waveguide elements in spaced relation to said conductor lines at at least one of a set of distances comprising about a half wavelength of said electric wave to be used and integral multiples of said half wavelength.

2. A plane antenna as set forth in claim 1, wherein:

said supporting means comprises a plate of low loss material having a thickness of about a half wavelength of said electric wave to be used or an integral multiple thereof and being situated between and connected to said microstrip line antenna and a dielectric film having said half wavelength waveguide elements formed thereon.

3. A plane antenna as set forth in claim 2, wherein:

said plate of low loss material comprises a foamed resin plate.

4. A plane antenna as set forth in claim 2, wherein:

said plate of low loss material comprises a honeycomb structure.

* * * * *